United States Patent [19]

Spencer

[11] 4,105,128

[45] Aug. 8, 1978

[54] WEAR SURFACE ARRANGEMENT FOR COUPLER CARRIER ASSEMBLY

[75] Inventor: Benjamin B. Spencer, Columbus, Ohio

[73] Assignee: Buckeye International, Inc., Columbus, Ohio

[21] Appl. No.: 714,646

[22] Filed: Aug. 16, 1976

[51] Int. Cl.[2] ..... B61G 9/22

[52] U.S. Cl. ..... 213/61; 308/3 R

[58] Field of Search ..... 213/61, 60, 20, 21; 308/3 R

[56] References Cited

U.S. PATENT DOCUMENTS

| | | | |
|---|---|---|---|
| 2,779,483 | 1/1957 | Furniss | 213/61 |
| 2,884,143 | 4/1959 | Blattner | 213/61 |
| 2,888,300 | 5/1959 | Curtis et al. | 308/3 R |

*Primary Examiner*—Trygve M. Blix
*Assistant Examiner*—Sherman D. Basinger
*Attorney, Agent, or Firm*—Charles F. Pigott, Jr.

[57] ABSTRACT

A coupler carrier assembly for an F type railroad car coupler utilizing a housing having large area wear plates located and secured by spaced lugs on the front and back walls of the housing. A pair of holes in each of the walls coincident with the plates are provided to facilitate welding of the plates to the walls and the housing back wall is straight to enable the use of a single large area flat wear plate on the back wall, which is interchangeably useable on the front wall.

3 Claims, 4 Drawing Figures

WEAR SURFACE ARRANGEMENT FOR COUPLER CARRIER ASSEMBLY

BACKGROUND OF THE INVENTION

1. Field of the Invention

The present invention relates in general to an arrangement for providing wear surfaces for a railroad car coupler carrier assembly and more particularly to an economical and effective method and arrangement for attaching large area wear plates to the walls of the carrier assembly housing.

2. Summary of the Prior Art

Railroad car couplers are usually resiliently supported on a carrier or spring basket assembly located adjacent the open end of the striker portion of the center sill. The carrier assembly comprises a carrier member having a top plate engaged with the shank portion of the coupler which extends through the open end of the striker portion. A plurality of springs are positioned between the top plate of the carrier and a bottom plate of the carrier housing. The carrier member has front and back vertical walls which engage a respective wall of the housing and in F type couplers the movement of the couplers which occurs both in horizontal and vertical planes in response to coupling and other forces, creates considerable wear on the front and back walls of the housing. The wear on the front wall extends over a considerable area and in some cases the wear becomes so pronounced that the walls are burned out and must be replaced by wear plates. To permit this condition to occur is obviously undesirable.

It is therefore one object of the present invention to initially provide improved wear surfaces for the housing of a carrier assembly.

The provision of improved wear surfaces for the assembly housing is however difficult since the housing is generally open only at the top and at several core or drain holes adjacent the bottom wall.

It is therefore another object of the present invention to enable an economical and/or facile attachment of wear plates to a carrier housing wall.

The back wall of the housing is usually provided with an arcuate or non planar portion while the front wall receives wear over a considerable area. The provision of a wear plate of corresponding shape to the back wall and having a sufficient bearing area for use on the front wall is therefore unfeasible.

It is therefore another object of the present invention to provide large area wear plates interchangeably useable for both the front and back walls of a carrier housing.

Summary of the Invention

The present invention provides a flat economical wear plate interchangeably useable on both the front and rear walls of the carrier assembly housing. To assist in locating and holding the wear plates in their respective position, each wall is also provided with a pair of spaced horizontally extending lugs or lips defining a recess therebetween corresponding to the width of each plate for locating and holding each of the wear plates in their respective position. Each wall is also provided with a pair of spaced holes coincident with the position of the wear plates to facilitate welding the plates to the walls at the holes from exterior of the housing. The perimeter of the plates is also welded where accessible.

The plates are thus secured by both the weld and mechanically locked against movement by the lugs.

In addition the back wall of the housing is straightened and each wall is moved outwardly from the center line of the housing to accommodate the thickness of the wear plates without changing or altering the contour or dimensions of the carrier member. This enables the use of large area interchangeable wear plates.

A more detailed explanation of the invention is provided in the following description and claims and is illustrated in the accompanying drawings.

DETAILED DESCRIPTION OF THE INVENTION

Figure 1:
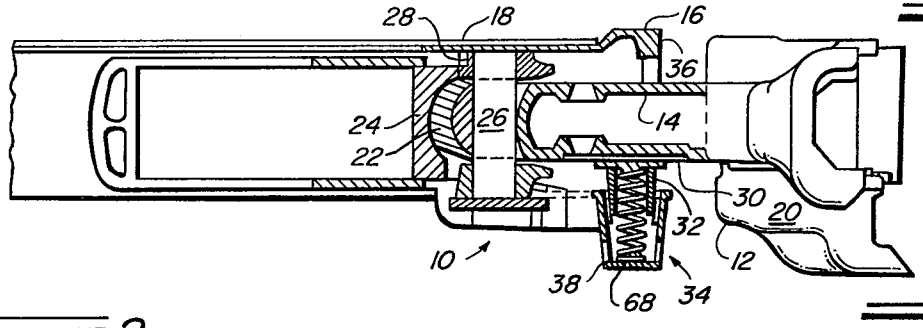
FIG. 1 is a generally sectional view of the relevant portions of a draft gear assembly illustrating a coupler carrier assembly employing the principles of the present invention.

In FIG. 1 a relevant portion of a draft gear assembly is indicated by the reference character 10. The assembly 10 includes an F type coupler 12 having a shank 14 extending through the open end of a striker portion 16 conventionally secured in a center sill 18.

The shank 14 extends between the coupler head 20, which projects forwardly of the striker portion 16 and a butt end portion 22 located in the center sill 18 for engagement with a follower 24. A connector pin 26 extending through the butt end portion 22 for connecting a yoke 28 to the coupler 12 and a wear plate 30 is usually welded to the bottom surface of the shank 14. The wear plate 30 or the shank rides upon or engages a carrier member 32 of a spring basket or coupler carrier assembly 34, which resiliently supports the coupler 12. The coupler 12 moves forwardly, rearwardly and vertically in both longitudinal and pivotal action to create considerable wear on the assembly 34 and the massive head 20 tends to pivot the coupler 12 clockwise as seen in FIG. 1. The load is therefore unequal and creates especially heavy wear on certain surfaces of the carrier assembly.

Figure 3:
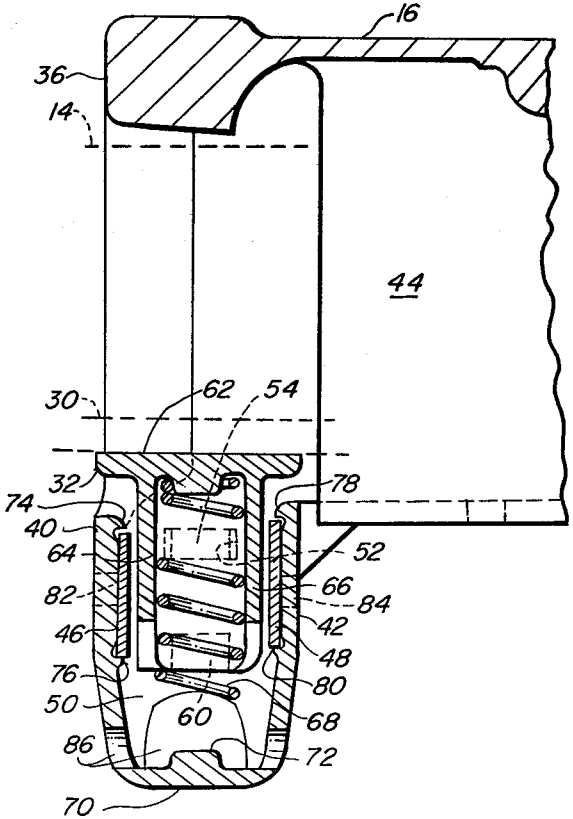
FIG. 3 is a sectional view of the coupler carrier assembly shown in FIG. 1 employing the principles of the present invention together with the associated striker portion.
Figure 2:
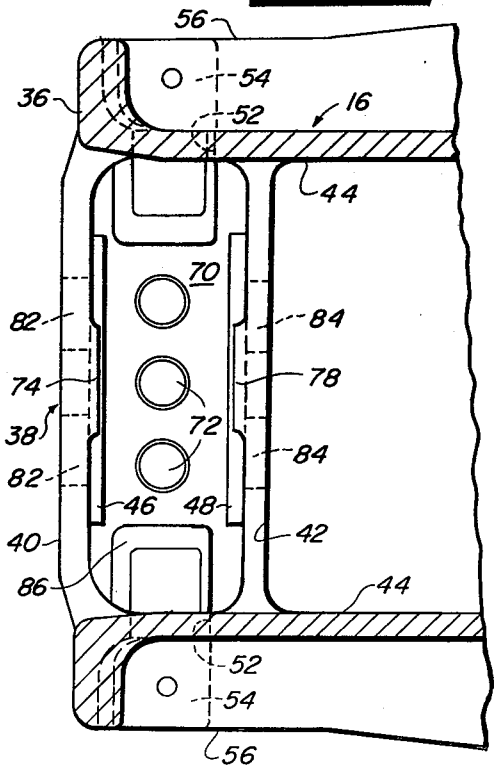
FIG. 2 is a top elevational view of the housing of the coupler carrier assembly shown in FIG. 1 and employing the principles of the present invention.
Figure 4:
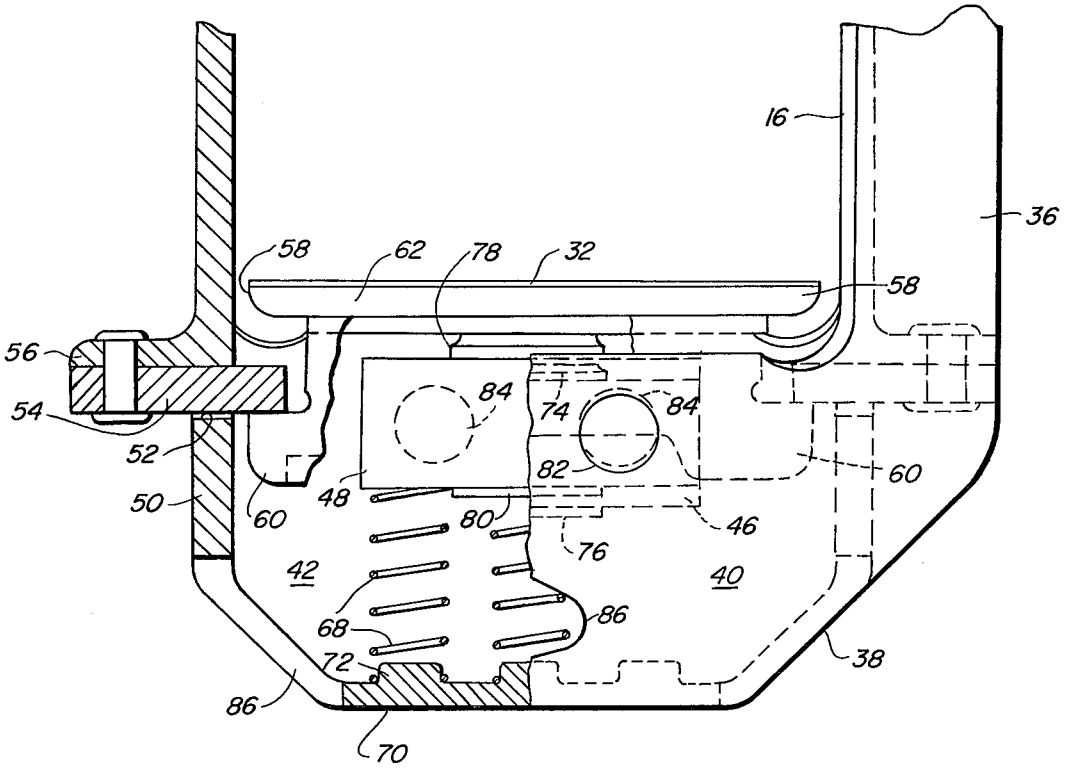
FIG. 4 is a front elevational view of the coupler carrier assembly shown in FIG. 1 partially broken away to illustrate the principles of the present invention.

The assembly 34 is located adjacent the open front face 36 of the striker portion 16 and comprises a cast spring basket or housing 38. Housing 38 includes a front wall 40 and a rear wall 42 each extending substantially straight between and below side walls 44 of the striker portion 16, as best seen in FIGS. 2–4. The front wall 40 and the rear wall 42 are each spaced outwardly of the spring basket center line by approximately ¼ inch more than the normal or conventional spring basket front and back wall spacing in order to accommodate a ¼ inch flat or planar rectangular wear plate 46 on the front wall 40 and an identically sized and shaped wear plate 48 on the rear wall 42. The standard or conventional dimension and contour of the carrier member 32 is retained unchanged.

Side walls 50 of the spring basket or housing 38 each has an opening 52 for passing a retaining portion of a respective carrier retainer member 54. Each carrier retainer member 54 is secured to a respective horizontal striker flange 56 behind the front face of the striker portion 16 by means of a rivet. Each retainer member 54 is adapted to engage either one of a pair of spaced laterally projecting upper and lower ears 58 and 60 extending from the opposite sides of the carrier member 32, as best seen in FIG. 4, to limit upward or downward movement respectively of the carrier member 32. The retaining members 54 are shown in FIG. 3 with the carrier member 32 omitted, it being understood that the retaining members are assembled, after the carrier member 32 is received in the housing 38.

The carrier member 32 is formed of cast steel and is provided with a top plate 62 whose upper surface engages the coupler wear plate 30. The carrier member 32 is also provided with spaced front and back walls 64 and 66 engaging the wear plates 46 and 48, respectively, and nestingly received between the wear plates and walls 40 and 42 which guide the movement of the carrier member. A plurality of spaced helical springs 68 are located between the lower surface of the carrier member upper plate 62 and a bottom plate 70 of the housing 38. A respective boss 72 is provided on each plate 62 and 70 for seating a respective one of springs 68.

The springs 68 resiliently bias the carrier member 32 upwardly for supporting the coupler 12 with the retainer member 54 normally located between respective ears 58 and 60 under the weight of the coupler, as indicated in FIG. 3, however the spring bias if unopposed permits the carrier member 32 to rise to the level seen in FIG. 4, where the lower ears 60 engage a respective retainer member 54.

The front wall 40 of the housing 38 is provided with upper and lower spaced horizontal lugs 74 and 76 and the rear wall 42 of housing 38 is provided with upper and lower spaced lugs 78 and 80, as best seen in FIG. 3. Lugs 74 and 78 are spaced just below the upper edge of the respective wall. Lug 74 is spaced from lug 76 and lug 78 is spaced from lug 80 by substantially 3 inches to define a recess therebetween. The lugs and recess thus serve to guide and locate the respective wear plates 46 and 48 relative the wall 40 and 42 since the wear plates are substantially 3 inches wide and their longitudinal or horizontal edges are received between and engaged by the respective lugs. The upper edge of the rear wall 42 is approximately ½ inch higher than the front wall 40 and lugs on walls 40 and 42 are displaced correspondingly from each other so that the upper edge of the rear plate 48 is higher than the upper edge of plate 46 and the upper edge of both plates are located adjacent the upper edge of the respective wall.

Each lug 74–80 extends substantially 1½ inches from the vertical axis of the housing 38 to provide a length of 3 inches and projects 3/16 inch from the respective recessed surface, while the wear plates 46 and 48 are substantially 7½ inches long and ¼ inch thick so that they extend beyond the ends of the lugs and project substantially 1/16 inch beyond or inwardly of the respective lugs 74–80 to engage the front and rear walls 64 and 66 of the carrier member 32 across a distance of substantially 7½ inches. The wear plates thus provide a large bearing or wearing surface transverse to the longitudinal axis of the coupler and are of a commercially available size, which need only be cut to length. An inwardly extending radius of substantially 1/16 inch is provided at the junction of each lug with the recessed wall surface engaging the respective plate.

It will be noted that the back or rear wall of the housing 38 extends straight between the striker walls 44 as compared with the conventional spring basket housing. This permits the long large bearing wear plates to be used on each wall and to be applied interchangeably on each housing wall.

In addition the front and back walls 40 and 42 are each provided with a pair of spaced passageways or holes 82 and 84 respectively. Holes 82 and 84 are in addition to the ordinary core or drain holes 86 located adjacent the bottom of the housing 38. Holes 82 and 84 are located intermediate the ends or edges of the wear plates and enable the wear plates to be facily welded from the exterior of the housing to the respective wall at the holes 82 or 84. Holes 84 are offset in a somewhat higher position than holes 82 to align with the center of plate 48 since that plate is somewhat higher than plate 46 as explained. The plates 46 and 48 are also welded to the respective housing wall at their perimeter, where accessible.

With the described arrangement the coupler 12 is resiliently supported on the carrier member 32 for longitudinal inward and outward movement in addition to vertical and pivotal movement. The carrier member 32 responds to the forces transmitted by the coupler 12 by acting against the wear plates 46 and 48, which are retained not only by the welds, but also by the mechanical restraint of the lugs 74–80.

It is understood that various modifications and substitutions may be made by those skilled in the art without departing from the novel spirit and scope of the invention.

What is claimed is:

1. A railway coupler carrier assembly of the type having a spring basket defining a carrier pocket with a plurality of compression springs vertically disposed therein, and a coupler carrier having an upper horizontal plate portion for supporting a coupler and a lower portion disposed in the carrier pocket and supported on the compression springs for vertical movement in the pocket, the improvement comprising, in combination, said spring basket including front and rear vertical walls defining a carrier pocket therebetween, said vertical walls having substantially flat opposed upper wall portions approximately parallel to one another and each having a pair of upper and lower horizontal lugs projecting toward the opposite wall and defining vertically spaced substantially horizontal upper and lower locating surfaces defining a recessed area therebetween, said upper lug being disposed adjacent an upper end of its vertical wall and said lower lug being disposed approximately midway between upper and lower ends of its vertical wall, a flat wear plate disposed in each of said two recessed areas, each wear plate being engaged flat against said upper wall portion and being welded thereto with upper and lower wear plate edges adjacent said upper and lower locating surfaces, and said flat wear plates being of a thickness which exceeds the amount by which said lugs project from said upper wall portions, whereby said wear plates guide said coupler carrier during its movement in said pocket and prevent said coupler carrier from engaging said horizontal lugs.

2. A railway coupler carrier assembly as defined in claim 1 where each of said upper wall portions has at least one opening formed therein to expose a portion of the adjacent wear plate, said wear plate being welded to said upper wall portion in the area of said opening.

3. A railway coupler carrier assembly as defined in claim 1 where each of said wear plates is generally rectangular and of a horizontal length at least approximately twice the vertical dimension of the plate.

* * * * *